United States Patent [19]

Ford

[11] Patent Number: 5,022,205

[45] Date of Patent: Jun. 11, 1991

[54] THERMAL BARRIER EXTRUSIONS

[75] Inventor: Jeffrey R. Ford, Oshtemo Township, Kalamazoo County, Mich.

[73] Assignee: Azon Systems, Inc., Kalamazoo, Mich.

[21] Appl. No.: 467,956

[22] Filed: Jan. 22, 1990

[51] Int. Cl.[5] ..... E04C 1/40

[52] U.S. Cl. ..... 52/309.16; 52/309.7; 52/309.9; 52/309.14; 52/730; 52/732

[58] Field of Search ..... 52/730, 402, 309.14, 52/309.7, 309.9, 309.8, 309.16, 393, 403

[56] References Cited

U.S. PATENT DOCUMENTS

| | | | |
|---|---|---|---|
| 3,191,727 | 6/1965 | Schmeltz et al. | 49/DIG. 1 |
| 3,823,524 | 7/1974 | Weinstein | 52/403 |
| 4,067,163 | 1/1978 | Hetman | 52/403 |
| 4,128,934 | 12/1978 | Doring | 52/730 |
| 4,395,862 | 8/1983 | Jäger et al. . | |
| 4,463,540 | 8/1984 | Gordon | 52/403 |
| 4,619,097 | 10/1986 | Trummer et al. . | |
| 4,841,700 | 6/1989 | Matthews . | |

FOREIGN PATENT DOCUMENTS

| | | | |
|---|---|---|---|
| 2543969 | 4/1977 | Fed. Rep. of Germany | 52/309.16 |
| 2639966 | 3/1978 | Fed. Rep. of Germany | 52/309.14 |
| 890513 | 2/1962 | United Kingdom | 52/309.9 |

*Primary Examiner*—Michael Safavi

*Attorney, Agent, or Firm*—Flynn, Thiel, Boutell & Tanis

[57] ABSTRACT

A structural, thermal barrier, architectural extrusion incorporating a rigid backbone which is embedded with the thermal break material in order to minimize relative longitudinal movement between the thermal break material and the extrusion.

17 Claims, 1 Drawing Sheet

THERMAL BARRIER EXTRUSIONS

This invention relates to structural, thermal barrier, architectural extrusions. More particularly, this invention relates to a structural, thermal barrier, aluminum, architectural extrusion having a member made of a polyurethane heat-insulating polymer as a thermal barrier between an outer extruded aluminum frame section and an inner extruded aluminum frame section. The polyurethane heat-insulating polymer is adhesively bonded and also is mechanically interlocked with the inner and outer frame sections in order to maintain the adhesive bond between the polyurethane polymer and the inner and outer frame sections and thereby prevent or minimize relative longitudinal movement therebetween that might otherwise occur due to thermal cycling of the architectural extrusion.

The term "architectural extrusion" refers to extrusions used to make various parts of buildings, for examples, window sashes (the part that contains the glass), window frames (the part that surrounds the sash) and framing members for curtain walls.

Architectural extrusions having a thermal barrier between the inner and outer parts thereof are well known. For example, in aluminum windows, the framing members are composed of an outer extruded frame section, an inner extruded frame section and a central, thermal barrier member or core which is joined to the inner and outer frame sections and connects them together to form a unitary, composite, framing member having structural integrity. The thermal barrier member is a good heat insulator and it possesses sufficient strength and durability that it will last for the service life of the window. The thermal barrier member acts as a barrier to heat flow between the inner and outer frame sections. It is conventional to use thermal barrier members made of polyurethane polymers.

In order to make the structural, thermal barrier, architectural extrusion, a one-piece, aluminum extrusion is prepared in which the inner and outer frame sections are joined by an intermediate, channel-shaped section. The channel-shaped section is defined by opposed walls of the inner and outer frame sections, which walls have substantially undercut cavities therein, and by a bridging wall forming the bottom of the channel. Liquid material for forming the thermal barrier is poured into the channel through the open or pour side thereof and is cured in the channel to solidify same. The bridging wall is then removed so that there is no metal continuity between the inner and outer frame sections; rather, the inner and outer frame sections are joined together only by the thermal barrier member.

In most instances, the thermal barrier material, such as polyurethane, adhesively bonds to the aluminum surfaces that it contacts to provide good initial shear strength. However, the shear strength of the adhesive bond between the polyurethane thermal barrier member and the aluminum, inner and outer frame sections can be reduced due to thermal cycling, that is, repeated heating and cooling of the extrusion. The coefficient of thermal expansion of polyurethane barrier materials is about four or five times higher than that of aluminum, so that the thermal barrier material tends to expand more when heated and to contract more when cooled. In other instances, the thermal barrier material may not adhesively bond well to the aluminum, inner and outer, frame sections due to an improper surface condition of the aluminum frame sections. For example, mill finish aluminum extrusions, aluminum extrusions with certain kinds of seal coats and aluminum extrusions coated with certain kinds of paints do not bond well to polyurethane thermal barrier material. Moreover, if the aluminum surfaces are contaminated with grease, oil, graphite, dirt or die lubricants, the polyurethane thermal barrier material does not bond well. Regardless of the specific cause, there has long been a significant problem of what is called "dry" shrinkage or "post" shrinkage of thermal barrier polymers in architectural extrusions. "Dry" or "post" shrinkage is to be distinguished from so-called "wet" shrinkage which refers to the shrinkage that occurs as the liquid polyurethane synthetic resin is cured to form the solid polyurethane thermal barrier material. "Dry" or "post" shrinkage is characterized by the uniform end-to-end or longitudinal shrinkage of the solid thermal barrier material with respect to the architectural extrusion and the loss of the adhesive bond of the thermal barrier material to the architectural extrusion. A consequence of this "dry" or "post" shrinkage is that internal gaps become present between the inner and outer frame sections at the ends of the extrusions, such as in mitered joints, resulting in air and water infiltration at those locations.

In addition to providing proper pre-treatment of the surface of the aluminum extrusion, it is also known to employ various kinds of mechanical interlocks, such as knurling, lanced openings, etc., to minimize "dry" or "post" shrinkage. However, the prior mechanical interlock designs have not been applicable to the wide diversity of shapes of architectural extrusions that are in use in industry. Moreover, the prior mechanical interlock designs have been relatively expensive to make and/or they are awkward and inconvenient to use.

SUMMARY OF THE INVENTION

It is, therefore, an object of the invention to provide an improved construction of a structural, thermal barrier, architectural extrusion having an improved mechanical interlock for the thermal barrier, which interlock can be used with a wide variety of different shapes of architectural extrusions.

It is another object of this invention to provide an improved mechanical interlock, as aforesaid, which is strong, light and simple, and which can be used efficiently and easily.

These and other objects of the invention are attained by the provision of a structural, thermal barrier, architectural extrusion comprising an inner frame section and an outer frame section which are spaced from each other and are connected by a substantially rigid, heat insulating, thermal barrier material. The inner and outer frame sections have cavities in the opposing surfaces thereof. The cavities have open sides facing each other and the cavities extend lengthwise in the frame sections. One or more rigid backbone(s) is (are) inserted and disposed in one or more of the cavities and extend longitudinally therein from one end to the other end thereof. When more than one backbone is used, the backbones are separate and spaced-apart from each other and are disposed in their associated cavities independently from each other. The thermal barrier material fills the cavity so that the backbone is embedded in the thermal barrier material. The thermal stresses that develop in the thermal barrier material due to thermal cycling and the like are thereby managed and controlled along the entire length of the extrusion so that the adhesive bond of the thermal barrier material to the inner and outer frame sections remains intact during thermal cycling.

The process for manufacturing the improved, structural, thermal barrier, architectural extrusion, according to the invention, can be the same as the conventional process used for making thermal barrier, architectural extrusions, except that the rigid backbone(s) is (are) placed in the cavity(s) before the thermal barrier material is poured into the channel whereby the backbone(s) is (are) embedded in the thermal barrier material in the finished structural, thermal barrier, architectural extrusion.

It is preferred that the inner and outer frame sections are made of aluminum. The surfaces of the frame sections should be such that the thermal barrier material will adhesively bond thereto with an acceptable degree of permanence and bond strength. Aluminum extrusions whose surfaces have been pretreated with chromium phosphate, zinc phosphate, zinc chromate, etc. in accordance with conventional practice in the art, are highly effective for the purposes of the invention. Mill finish aluminum extrusions and aluminum extrusions with other surface treatments can be used, provided that the strength of the adhesive bond, augmented by the backbone(s), is (are) sufficiently high that the adhesive bond is not broken by thermal cycling.

The cavities in the inner and outer frame sections are preferably substantially C-shaped in cross-section. The backbone is preferably an aluminum wire of substantially sinusoid shape. An aluminum wire is disposed in one or, preferably, both of the cavities with its crests and troughs being disposed close to, and preferably slidably contacting, the upper and lower walls of the cavity. The aluminum wire can be slid longitudinally into the cavity before the thermal barrier material is poured into the cavity. After the wire is in place in the cavity, it will be retained in place therein due to frictional sliding contact with the upper and lower walls of the cavity. Further, flanges are provided on the walls of the cavity so that the aluminum wire cannot move to an appreciable extent sidewardly in the cavity.

The thermal barrier material fills the channel and also substantially completely fills the cavities. The aluminum wire(s) is (are) thereby embedded in the thermal barrier material whereby to provide a mechanical interlock between the thermal break material and the inner and outer frame sections. Because of the aluminum wire, a more durable adhesive bond will be maintained between the inner and outer frame sections and the polyurethane thermal barrier material. In particular, in addition to the micro-mechanical adhesion provided by the thermal barrier material flowing and filling micro cavities in the frame sections, the use of the aluminum wire will provide a macro-scale mechanical interlock between the thermal barrier material and the frame section.

DESCRIPTION OF THE PREFERRED EMBODIMENT

Figure 1:
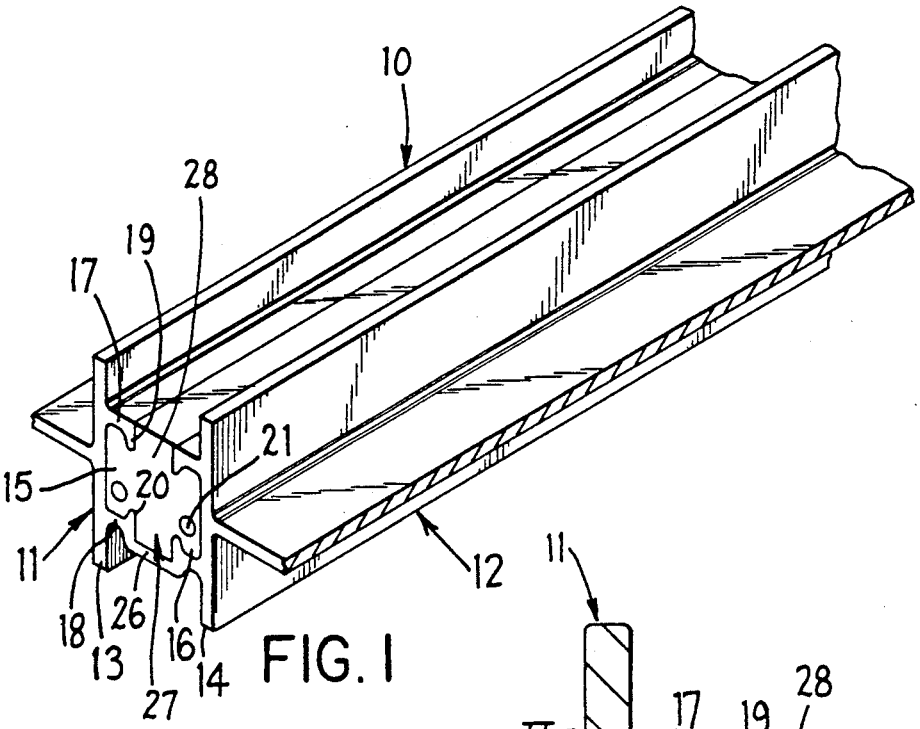
FIG. 1 is a perspective view of an architectural extrusion incorporating the preferred embodiment of the invention, the extrusion being shown before the bridging wall is removed.

FIG. 1 shows a typical, representative, aluminum, architectural extrusion 10 incorporating the preferred embodiment of the invention. The exact shape of the extrusion 10 will vary widely depending on its intended use. The invention is not limited to any particular shape of the extrusion 10. One of the advantages of the invention is that it can be employed on virtually any structural, thermal barrier, architectural extrusion.

Figure 3:
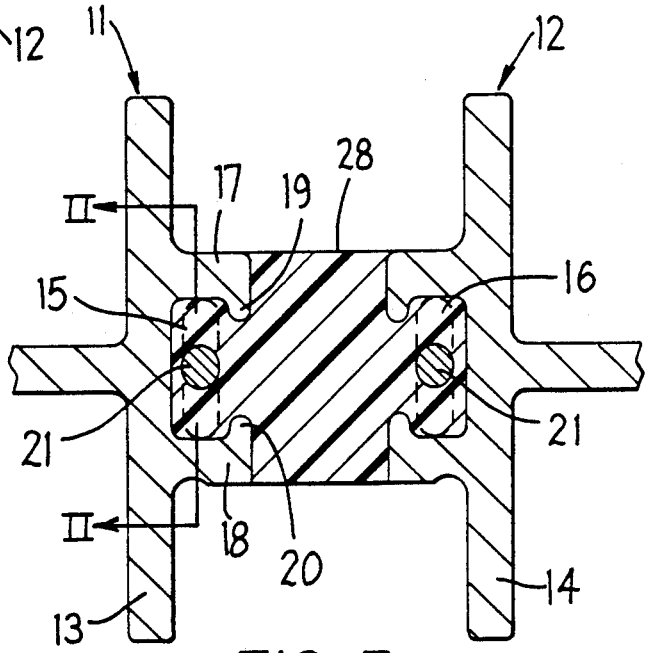
FIG. 3 is a transverse cross-sectional view of the extrusion and showing the thermal barrier material in the channel and showing the architectural extrusion after the bridging wall has been removed.

The extrusion 10 is comprised of an elongated inner frame section 11 and an elongated outer frame section 12. Usually, both of these frame sections are part of a one-piece aluminum extrusion to start with, as shown in FIG. 1, and they are separated from each other when the bridging wall 26 is removed as described hereinbelow and as shown in FIG. 3. The inner and outer frame sections 11 and 12 have walls 13 and 14 which are positioned in opposed, spaced-apart relationship with the longitudinal axes thereof being substantially parallel. Cavities 15 and 16 are provided on the opposing walls 13 and 14 of the inner and outer frame sections 11 and 12. Referring to FIG. 3, each of the cavities 15 and 16 is defined by inwardly projecting upper and lower walls 17 and 18 and those walls have flanges 19 and 20 projecting therefrom partway toward the other wall whereby the cavities 15 and 16 are substantially C-shaped in cross-section and their open sides face each other. The cavities 15 and 16 extend the entire length of the extrusion.

In accordance with this invention, an elongated wire 21, preferably made of aluminum, and which is of sinusoid shape, is slidably disposed and extends lengthwise in one or both of the cavities 15 and 16. In the preferred embodiment of the invention illustrated in the drawings, wires 21 are disposed in both of the cavities 15 and 16. The overall length of each of the wires 21 is the same as the length of the extrusion so that the wires extend from one longitudinal end to the other of the extrusion. The wire(s) 21 can be of any suitable cross-section, such as circular, and the stiffness and width thereof is (are) such that it (they) can be received snugly but longitudinally slidably in their associated cavity. The alternating crests 22 and troughs 23 of the wire 21 slidably contact the opposing surfaces of the walls 17 and 18 so that the crests and troughs will be in frictional slidable contact therewith. Moreover, the crests 22 and troughs 23 of the wire 21 extend above and below the free edges of the flanges 18 and 19, respectively, so that the wire 21 cannot be moved laterally through the open side of its assOciated cavity.

The structure comprised of the extrusion 10 and wire(s) 21 is assembled, prior to forming the thermal barrier material, by inserting one end of each of the wires 21 into its associated cavity 15 or 16 and then pushing or pulling the wire longitudinally therein so that it slides lengthwise within the cavity.

Referring to FIG. 1, initially the extrusion 10 will have the bridge wall 26 joining the lower walls 18 of the cavities 15 and 16. The bridge wall 26 and the walls defining the cavities 15 and 16 form a channel 27 for receiving the thermal barrier material. The liquid thermal barrier material, such as polyurethane polymer resin, is poured into the channel 27 in order to fill the cavities 15 and 16 and the space between those cavities. In so doing, the liquid, thermal barrier material will substantially completely fill the cavities 15 and 16 and will surround and embed the wire(s) 21. The thermal barrier material is cured to a solid state whereby to form a rigid, heat-insulating block 28 which substantially rigidly interconnects the inner and outer frame sections 11 and 12.

The bridge wall 26 is then removed from the extrusion 10 in the usual way. The inner and outer frame sections 11 and 12 thereby come to be connected only by the block 28 of heat-insulating material. Preferably, there is no metal connection between the inner and outer frame sections 11 and 12 in the finished aluminum extrusion, as shown in FIG. 3.

The sinusoid shape of the wire 21 in the cavities 15 and/or 16 and the thermal barrier material that fill the cavities provides a mechanical interlock effective to minimize or prevent relative longitudinal movement between the inner and outer frame sections 11 and 12, on the one hand, and the block 28 of thermal barrier material, on the other hand. Moreover, the undercut shape of the cavities 15 and 16 prevents relative lateral movement between the inner and outer frame sections 11 and 12 and the block 28 of thermal barrier material. Since the coefficient of thermal expansion of the thermal barrier material is normally higher than that of aluminum, stresses may develop in the thermal barrier material as a result of thermal cycling. However, the structure of the invention confines and limits this stress to minimize the risk of a total loss of adhesive bonding between the inner and outer frame sections and the thermal barrier material.

Figure 2:
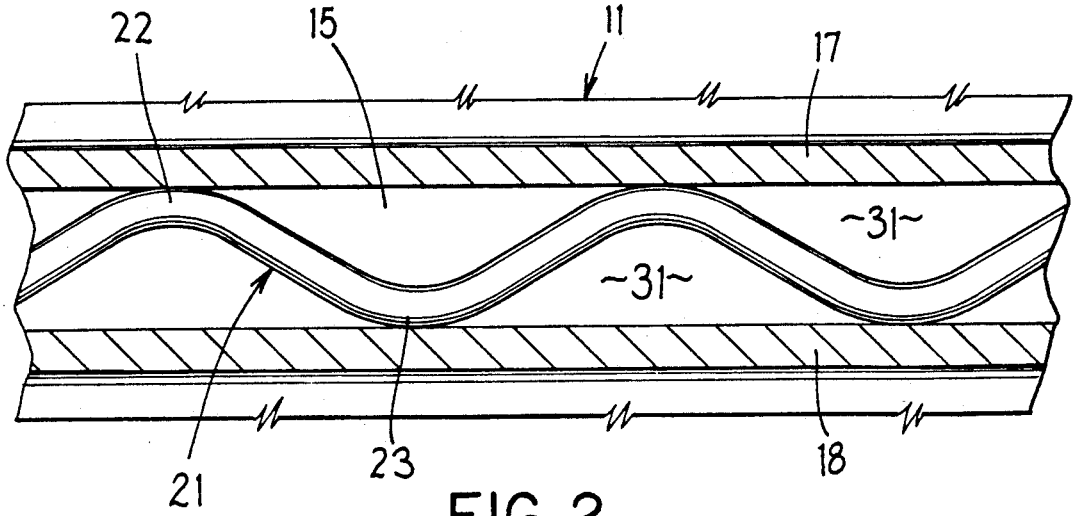
FIG. 2 is a longitudinal cross-sectional view taken along the line II—II of FIG. 3.

The wire(s) 21 divide the thermal barrier material in the cavities 15 and 16 into portions 31 which are substantially triangular in longitudinal cross-section (FIG. 2). Longitudinal expansion of the triangular portions 31 of the thermal barrier material relative to the wire(s) 21 and the extrusion will be resisted by the wedging action of the troughs and crests of the wire(s) 21. The shear strength of the adhesive bond will be greater than the shearing force applied thereon by the thermal barrier material so that the adhesive bond will remain intact.

The present invention provides a substantial improvement in structural, thermal barrier, architectural extrusions. The problem of "dry" shrinkage or "post" shrinkage is substantially corrected with little extra expense. The invention can be employed on a wide variety of thermal barrier, architectural extrusions prepared by the pour-in-place method because it involves simply sliding an appropriate wire into the cavity already provided for receiving the thermal barrier material.

The invention contemplates such modifications or changes therein as lie within the scope of the appended claims.

The embodiments of the invention in which an exclusive property or privilege is claimed are defined as follows:

1. An architectural component, comprising: elongate, spaced, parallel, first and second frame members each made of a material with a high thermal conductivity; a thermal barrier member extending between said frame members and made of a material with a low thermal conductivity; interconnecting means which includes cooperating structure on said first frame member and said barrier member for substantially rigidly interconnecting said first frame member and said barrier member, and which includes cooperating structure on said second frame member and said barrier member for substantially rigidly interconnecting said second frame member and said barrier member, said interconnecting means restraining movement of each said frame member relative to said barrier member; and an elongate backbone member substantially embedded in said barrier member and having at spaced locations therealong a plurality of first portions which are each in direct contact with said first frame member at spaced locations along said first frame member, said backbone member having between each adjacent pair of said first portions a second portion which is free of engagement with said first frame member.

2. An architectural component according to claim 1, wherein said interconnecting means includes said first frame member having a cavity which opens thereinto from a side thereof facing said second frame member, said cavity extending lengthwise of said first frame member and having facing first and second surfaces on opposite sides thereof, said first portions of said backbone member each being in engagement with said first frame member at respective locations on said first surface, said backbone member including between each adjacent pair of said first portions two of said second portions which have therebetween a third portion, said third portions each being in direct contact with said second surface of said first frame member at spaced locations therealong.

3. An architectural component according to claim 2, wherein said first frame member has two lengthwise flanges which extend toward each other from edges of said first and second surfaces nearest said second frame member.

4. An architectural component as recited in claim 2, wherein said backbone member is sinuous in shape and has alternating crests and troughs therealong, said first portions thereof being said crests, said third portions thereof being said troughs, and said second portions being portions thereof between said crests and said troughs.

5. An architectural component as recited in claim 4, wherein said sinuous backbone member is substantially sinusoidal in shape.

6. An apparatus as recited in claim 5, wherein said backbone is a single elongate integral piece of substantially rigid wire.

7. An architectural component according to claim 1, including a second elongate backbone member substantially embedded in said barrier member and having at spaced locations therealong a plurality of first portions which are each in direct contact with said second frame member at spaced locations therealong, said second backbone member having between each adjacent pair of said first portions thereof a second portion which is free of engagement with said second frame member, said first-mentioned backbone member being free of engagement with said second backbone member and said second frame member, and said second backbone member being free of engagement with said first frame member.

8. An architectural component according to claim 7, wherein said interconnecting means includes said first frame member having a first cavity which opens thereinto from a side thereof facing said second frame member, said first cavity extending lengthwise of said first frame member and having facing first and second surfaces on opposite sides thereof, said first portions of said first-mentioned backbone member each being in engagement with said first frame member at respective locations on said first surface thereof, said first-mentioned backbone member including between each adjacent pair of said first portions thereof two of said second portions thereof which have therebetween a third portion, said third portions thereof each being in direct contact with said second surface of said first frame member at spaced locations therealong; and wherein said interconnecting means includes said second frame member having a second cavity which opens thereinto from a side thereof facing said first frame member, said second cavity extending lengthwise of said second frame member and having facing first and second surfaces on opposite sides thereof, said first portions of said second backbone member each being in engagement with said second frame member at respective locations on said first surface thereof, said second backbone member including between each adjacent pair of said first portions thereof two of said second portions thereof which have therebetween a third portion, said third portions thereof each being in direct contact with said second surface of said second frame member at spaced locations therealong.

9. An architectural component as recited in claim 1, wherein said backbone member has a high thermal conductivity.

10. An architectural component as recited in claim 9, wherein said frame members and said backbone member are made of metal, and wherein said barrier member is made of a polyurethane resin material.

11. An architectural component as recited in claim 10, wherein said polyurethane resin material is inherently adhesively bonded to each of said frame members.

12. An architectural component according to claim 10, wherein said frame members are each an extrusion.

13. An architectural component as recited in claim 1, wherein said backbone member is sinuous in shape.

14. An architectural component according to claim 1, wherein said frame members each have a coefficient of thermal expansion which is substantially different from a coefficient of thermal expansion of said barrier member, wherein said backbone member has a coefficient of thermal expansion approximately equal to the coefficient of thermal expansion of said first frame member, and wherein said backbone member is substantially rigid.

15. A structural, thermal barrier, architectural extrusion, comprising:

an inner, elongated, extruded aluminum frame section;

an outer, elongated, extruded aluminum frame section, said inner and outer frame sections being positioned in parallel, adjacent, spaced-apart relation to each other and having opposed surfaces, each of said surfaces having upper and lower, longitudinally extending walls projecting therefrom toward the opposing surface, said upper and lower walls each having a flange at its free end which flange extends toward the other one of said upper and lower walls, said walls and flanges defining an undercut, substantially C-shaped cavity which opens toward the opposing surface;

at least one elongated, sinuous wire slidably disposed in one of said cavities and extending lengthwise therein with the crests and troughs of said wire bearing against said upper and lower walls and said wire being located in said cavities inwardly from said flanges;

a block of polyurethane resin thermal barrier material formed in situ in said cavities and extending between them to connect said inner and outer frame sections solely by said thermal barrier material, said thermal barrier material filling said one cavity and encapsulating the wire therein whereby to restrain movement of said polyurethane resin thermal barrier material relative to said inner and outer frame sections.

16. An architectural extrusion as claimed in claim 15, in which said wire divides said thermal break material in said one cavity into portions which are substantially triangular in longitudinal cross-section, said portions being wedged by the parts of said wire that are in contact therewith in order to reduce the shearing force applied on the adhesive bond during thermal cycling.

17. An architectural extrusion as claimed in claim 15 in which a pair of separate, sinuous wires are independently slidably disposed one in each of said cavities.

* * * * *

UNITED STATES PATENT AND TRADEMARK OFFICE

CERTIFICATE OF CORRECTION

PATENT NO. : 5 022 205

DATED : June 11, 1991

INVENTOR(S) : Jeffrey R. FORD

It is certified that error appears in the above-identified patent and that said Letters Patent is hereby corrected as shown below:

Column 3, lines 55-56; replace "section" with ---sections---.

Column 8, line 21; replace "cavities" with ---one cavity---.

line 27; replace "one cavity" with ---cavities---.

Signed and Sealed this

Twenty-third Day of February, 1993

*Attest:*

STEPHEN G. KUNIN

*Attesting Officer*

*Acting Commissioner of Patents and Trademarks*